US007159416B2

(12) United States Patent
Park

(10) Patent No.: US 7,159,416 B2
(45) Date of Patent: Jan. 9, 2007

(54) HEAT GENERATING EXPANDER FOR HEAT PUMP SYSTEMS

(75) Inventor: Young Kyu Park, Simsbury, CT (US)

(73) Assignee: Carrier Corporation, Syracuse, NY (US)

( * ) Notice: Subject to any disclaimer, the term of this patent is extended or adjusted under 35 U.S.C. 154(b) by 111 days.

(21) Appl. No.: 10/734,085

(22) Filed: Dec. 11, 2003

(65) Prior Publication Data

US 2005/0126217 A1 Jun. 16, 2005

(51) Int. Cl.
*F25B 27/00* (2006.01)
*F25B 41/00* (2006.01)

(52) U.S. Cl. ..... 62/527; 62/238.6

(58) Field of Classification Search ..... 62/115, 62/324.1, 324.6, 498, 500
See application file for complete search history.

(56) References Cited

U.S. PATENT DOCUMENTS

| | | | | |
|---|---|---|---|---|
| 3,277,658 | A | 10/1966 | Leonard, Jr. | |
| 4,197,715 | A * | 4/1980 | Fawcett et al. | 62/115 |
| 4,235,079 | A | 11/1980 | Masser | |
| 5,131,238 | A * | 7/1992 | Meckler | 62/271 |
| 5,216,899 | A * | 6/1993 | Fabris | 62/324.6 |
| 5,819,554 | A | 10/1998 | Glen | |
| 6,349,547 | B1 * | 2/2002 | Miller et al. | 62/63 |
| 6,543,238 | B1 | 4/2003 | Yamanaka et al. | |
| 6,606,860 | B1 * | 8/2003 | McFarland | 60/648 |

* cited by examiner

*Primary Examiner*—Melvin Jones
(74) *Attorney, Agent, or Firm*—Carlson, Gaskey & Olds

(57) ABSTRACT

An expander controls the expansion and flow of refrigerant between high and low pressure within a vapor compression system. The expander drives a shaft that in turn drives a friction disk within a friction heat generator. Frictional contact between the friction disk and the plate generates heat. The friction heat generator transfers heat to the water circuit to elevate the temperature of water.

18 Claims, 2 Drawing Sheets

HEAT GENERATING EXPANDER FOR HEAT PUMP SYSTEMS

BACKGROUND OF THE INVENTION

This invention relates to a vapor compression system, and specifically to an expander for a heat pump water-heating system.

Typically, a vapor compression system used in a heat pump water-heating system includes an expander for regulating the flow of refrigerant between high-pressure and low-pressure portions of the system. Refrigerant flowing between high and low pressure portions of the vapor compression system releases energy in the isenthalpic or free expansion of the refrigerant. The energy released by the expanding refrigerant is typically lost.

A heat-pump water heating system includes a vapor compression system that heats water within a water circuit. Heated water within the water circuit in turn heats water within a hot water tank. The efficiency of the system is based on the amount of energy input into the system relative to the amount of work provided by the system. Any loss of energy within the system results in an overall reduction in efficiency. Improvement to system efficiency can result in large savings over the operating life of the heat-pump water heating system.

Accordingly, it is desirable to design a system that captures energy released by refrigerant within the expander.

SUMMARY OF INVENTION

The present invention is an expander for a heat pump hot water heating system that captures energy released during expansion of refrigerant to drive a heat-generating device that heats water within a water circuit.

The heat pump water heating system includes a refrigerant circuit for transferring heat to a water circuit to heat water within a hot water tank. The refrigerant circuit includes a compressor, a heat exchanger, an expander and an evaporator. A water circuit flows through the heat exchanger and is in thermal contact with the refrigerant circuit. The expander controls the expansion and flow of refrigerant between high-pressure and low-pressure portions of the system.

The expander includes a device for converting expansion of refrigerant to rotation of a shaft. The expanding refrigerant flowing from the high-pressure portion to the low-pressure portion of the refrigerant circuit produces energy that is converted to rotation of the shaft to turn a friction member within a friction heat generator. Friction material disposed on a face of the friction member contacts a fixed member. Frictional contact between the friction member and the fixed member generates heat. The friction heat generator transfers heat to water within the water circuit to elevate the temperature of water. Elevation of water temperature reduces the amount of heat exchange required within the heat exchanger to provide an overall increase in system efficiency.

Accordingly, the expander of this invention captures energy released during the expansion of refrigerant to drive a friction heat generator for heating of water within the water circuit.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
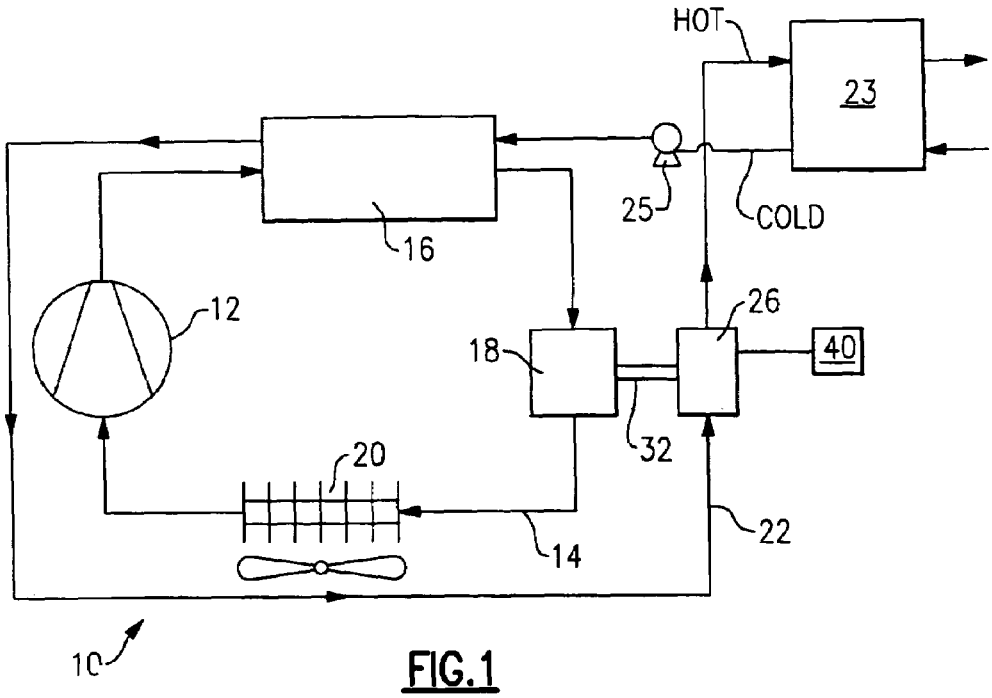
FIG. 1 is a schematic view of a heat pump system including an expander according to this invention.

Referring to FIG. 1 a heat pump water heater 10 includes a vapor compression circuit 14 that transfers heat to a water circuit 22 that in turn heats water within a water tank 23. Water is circulated within the water circuit 22 by a pump 25. A refrigerant within the vapor compression circuit 14 moves between high-pressure and low-pressure portions of the circuit 14 through an expander 18. The circuit 14 utilizes a refrigerant that exceeds a critical pressure when discharged from a compressor 12. Preferably, the refrigerant is carbon dioxide (CO2), however, systems utilizing other refrigerant formulations will also benefit from the disclosures of this invention.

The circuit 14 includes the compressor 12, a heat exchanger 16, the expander 18 and an evaporator 20. The water circuit 22 flows through the heat exchanger 16 and is in thermal contact with the circuit 14. The refrigerant absorbs heat within the evaporator 20 and increases in enthalpy. The compressor 12 increases the pressure of the refrigerant, resulting in an increase in temperature. High pressure, high temperature refrigerant rejects heat to water within the water circuit 22 within the heat exchanger 16. High pressure, low temperature refrigerant enters the expander 18 and undergoes expansion. Refrigerant emerging from the expander 18 is at a low pressure and low temperature. The expander 18 drives a friction heat generator 26 that utilizes energy expended by free expansion of refrigerant to heat water within the water circuit 22.

Figure 2:
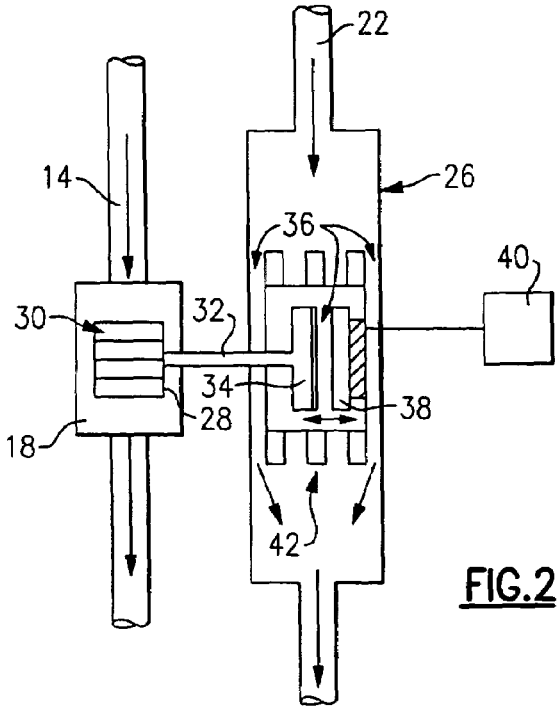
FIG. 2 is a schematic view of the expander and heat generator according to this invention.

Referring to FIG. 2, the expander 18 includes a rotor 28 driven by expanding refrigerant flowing from the high-pressure portion to the low-pressure portion of the vapor compression circuit 14. Preferably, the rotor 28 includes a plurality of radially extending vanes 30 shaped to cause rotation in response to expanding refrigerant. The size and specific shape of the rotor 28 are application dependent, and a worker skilled in the art, with the benefit of this disclosure would understand how to configure the rotor 28 to optimally reclaim expansion energy. The rotor 28 is mounted to rotate a shaft 32. The shaft 32 extends from the expander 18 and drives a friction disk 34 within the friction heat generator 26.

The shaft 32 rotates the friction disk 34 disposed within the friction heat generator 26. Friction material 36 disposed on the friction disk 34 contacts a plate 38 that is fixed to prevent rotation with the friction disk 34. The plate 38 also includes friction material 36. A drive 40 controls a load exerted between the friction disk 34 and plate 38. Frictional contact between the friction disk 34 and the plate 38 generates heat. The amount of heat generated is dependent on the load exerted between the friction disk 34 and the plate 38.

The friction heat generator 26 is preferably disposed within the flow of water through the water circuit 22. The friction heat generator 26 includes a heat-transmitting surface 42 to maximize heat transmission to the water circuit 22. The transfer of heat to the water circuit 22 elevates the temperature of water.

In operation, refrigerant flowing through the expander 18 drives rotation of the rotor 28. Rotation of the rotor 28 in turn rotates the friction disk 34 within the friction heat generator 26. The drive 40 moves the plate 38 axially into contact with the rotating friction disk 34. The resulting contact between the friction disk 34 and the plate 38 generates heat. The generated heat is transmitted through the heat-transmitting surface 42 to water flowing within the water circuit 22 to elevate the temperature of the water.

The drive 40 controls the magnitude of load applied between the friction disk 34 and the plate 38. Changing the amount of load between the friction disk 34 and the plate 38 controls the generation of heat. Further, the load applied increases the resistance to rotation of the rotor 28. Varying the load placed on the rotor 28 controls the refrigerant high-side pressure and flow rate. With an increased load, the refrigerant high-side pressure increases while its flow rate is reduced. Reducing the load on the friction disk 34 will increase refrigerant flow, while decreasing the refrigerant high-side pressure.

Varying the load will also affect heat generation. Further reductions in load, approaching complete disengagement between the friction disk 34 and plate 38, reduces the magnitude of heat generation. The specific loads required to optimize the refrigerant high-side pressure and heat generation are continuously adjusted to provide optimal capture of energy. A worker skilled in the art with the benefit of this disclosure would understand how to program and control the drive 40 to control refrigerant expansion and heat generation.

Figure 3:
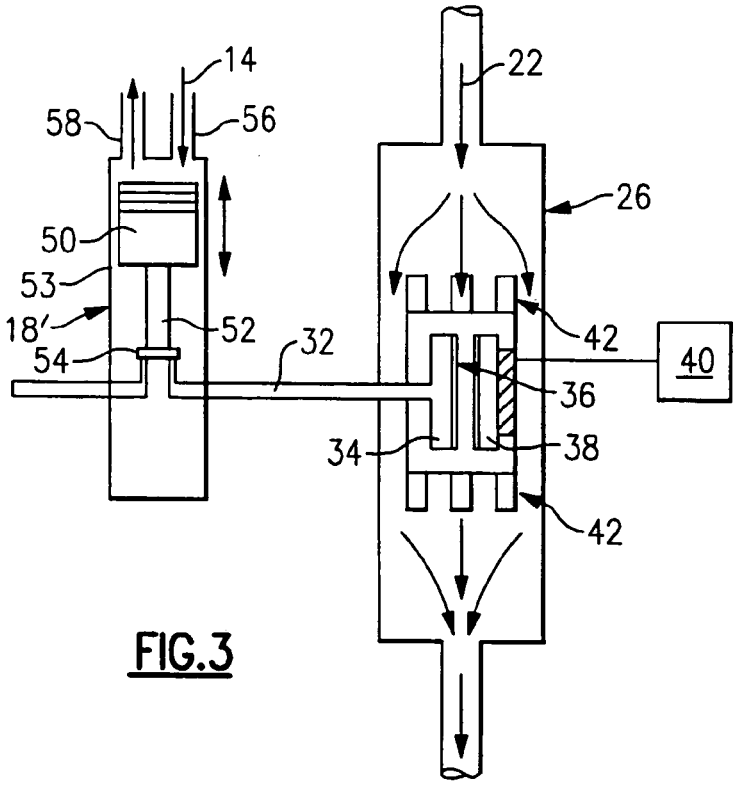
FIG. 3 is a schematic view of another expander according to this invention.

Referring to FIG. 3, another expander 18' according to this invention is schematically illustrated and includes a piston 50 moving in a chamber 53 in response to expanding refrigerant. The chamber 53 includes an inlet 56 and an outlet 58. Flow of refrigerant within the circuit 14 is regulated by sequentially opening and closing valves to move the piston 50. Movement of the piston 50 is transmitted through connecting rod 52 and a pivotal connection 54 to the shaft 32. The rotation of shaft 32 in turn rotates the friction disk 34 within the friction heat generator 26.

Figure 4:
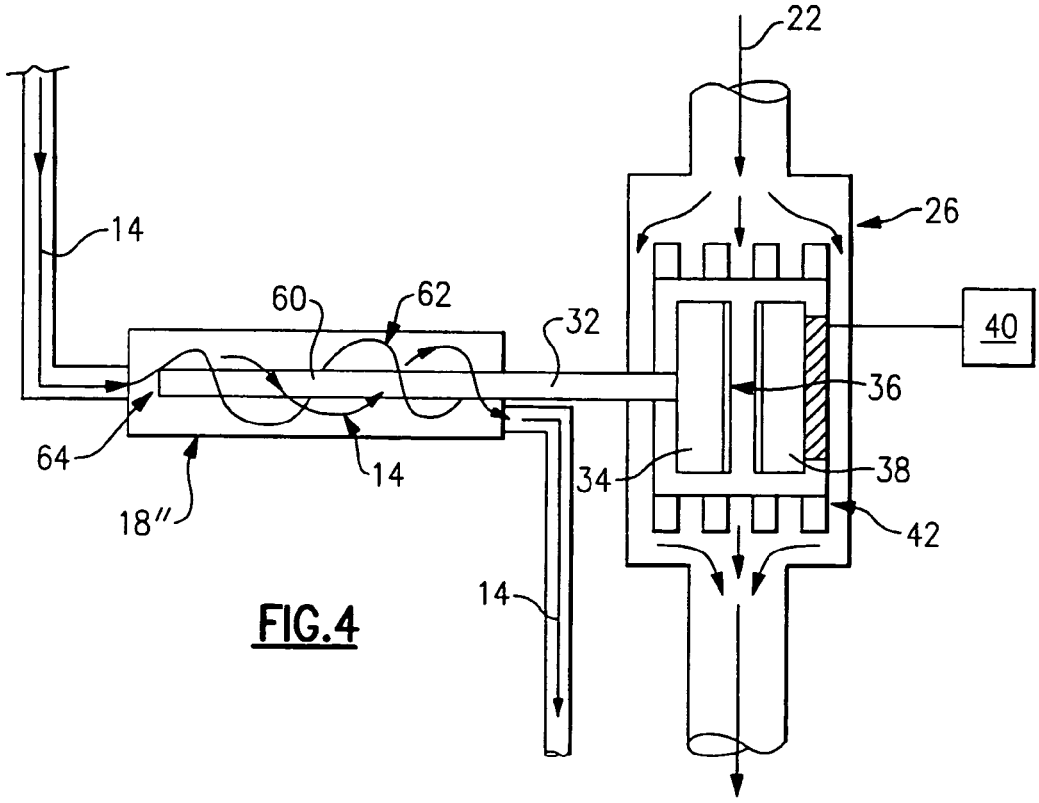
FIG. 4 is a schematic view of another expander according to this invention.

Referring to FIG. 4, another expander 18" is shown schematically, and includes a bladed shaft 60. The bladed shaft 60 includes a vane 62 extending radially about the shaft 60. The vane 62 extents about an axis 64 of the shaft 60 such that expanding within the circuit refrigerant 14 forces rotation of the vane 62 and thereby the shaft 60. The shaft 60 in turn rotates the shaft 32 that extends from the friction heat generator 26. The shaft 60 may be a portion of the shaft 32 or a separate shaft connected to drive the shaft 32.

Although several specific examples of the expander 18 for converting expansion of refrigerant into rotation of the shaft 32 have been disclosed, a worker skilled in the art with the benefit of this disclosure would understand that other expander configurations are within the contemplation of this invention.

The expander 18 of this invention provides for the capture of energy expanded during the expansion of refrigerant from high-pressure to the low-pressure. The friction heat generator 26 converts energy expanded from expanding refrigerant to provide additional heating of water within the water circuit 22. The additional heating of water increases overall system efficiency.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

I claim:

1. An expander assembly for a vapor compression system comprising:

a first member movable responsive to flow of a refrigerant; and a friction device driven by said member for generating heat, wherein said expander assembly controls expansion of a refrigerant between high and low pressure portions of said vapor compression system.

2. The assembly of claim 1, wherein said first member comprises a bladed member attached to a shaft, said bladed member rotatable responsive to flow of a refrigerant.

3. The assembly as recited in claim 1, wherein said first member comprises a piston movable within a cylinder in response to flow of the refrigerant.

4. The assembly as recited in claim 1, wherein said first member comprises a shaft having a vane portion rotatable responsive to flow of refrigerant.

5. The assembly of claim 1, wherein said friction device comprises a heat transfer surface.

6. The assembly of claim 5, wherein said heat transfer surface performs heat exchange with water.

7. An expander assembly for a vapor compression system comprising:

a first member movable responsive to flow of a refrigerant;

a friction device driven by said member for generating heat, wherein said friction device comprises a friction disk rotatable to develop heat and said heat developed by said friction disk is related to a load placed on said friction disk; and a load-generating device for controlling said load on said friction disk.

8. The assembly of claim 7, wherein said load generating device varies a load placed on said friction disk for controlling expansion of said refrigerant.

9. A heat pump water heater assembly comprising:

an expander for controlling expansion of a refrigerant; and a friction device driven by said refrigerant within said expander for generating heat.

10. The assembly of claim 9, wherein said expander comprises a rotatable member rotatable responsive to flow of a refrigerant.

11. The assembly of claim 9, wherein said friction device comprises a heat transfer surface.

12. The assembly of claim 11, wherein said heat transfer surface performs heat exchange with water.

13. The assembly of claim 12, wherein said heat transfer surface is adjacent water within a water circuit and transfers heat to water.

14. A heat pump water heater assembly comprising:

an expander for controlling expansion of a refrigerant; and a friction device driven by said refrigerant within said expander for generating heat, wherein said friction device comprises a friction disk rotatable to develop heat.

15. The assembly or claim 14, wherein said heat developed by said friction disk is controlled by a load placed on said friction disk.

16. The assembly of claim 15, comprising a load-generating device for controlling said load on said friction disk.

17. The assembly of claim 15, wherein said load generating device varies a load placed on said friction disk for controlling expansion of said refrigerant.

18. A heat pump water heater assembly comprising:

a transcritical vapor compression system;

an expander for controlling expansion of refrigerant; and a friction device driven by said refrigerant within said expander for generating heat.

* * * * *

UNITED STATES PATENT AND TRADEMARK OFFICE

CERTIFICATE OF CORRECTION

PATENT NO. : 7,159,416 B2
APPLICATION NO. : 10/734085
DATED : January 9, 2007
INVENTOR(S) : Young Kyu Park It is certified that error appears in the above-identified patent and that said Letters Patent is hereby corrected as shown below:

Claim 15, Column 5, line 8: "or" should be --of--

Signed and Sealed this

Twenty-seventh Day of March, 2007

JON W. DUDAS
*Director of the United States Patent and Trademark Office*